US006817117B1

(12) United States Patent
Campbell

(10) Patent No.: US 6,817,117 B1
(45) Date of Patent: Nov. 16, 2004

(54) GOLF SHOE OUTSOLE WITH ORIENTED TRACTION ELEMENTS

(75) Inventor: Derek Campbell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 81 days.

(21) Appl. No.: 10/093,362

(22) Filed: Mar. 5, 2002

(51) Int. Cl.[7] ..... A43C 15/02
(52) U.S. Cl. ..... 36/127; 36/59 R; 36/59 C
(58) Field of Search ..... 36/127, 59 R, 36/67 R, 67 A, 59 C, 126, 128

(56) References Cited

U.S. PATENT DOCUMENTS

| | | | | | |
|---|---|---|---|---|---|
| 1,011,110 | A | * | 12/1911 | Brown | 36/59 A |
| 1,087,212 | A | | 2/1914 | Caldwell | |
| 2,336,632 | A | * | 12/1943 | Park | 36/59 R |
| 3,494,055 | A | * | 2/1970 | McSorley | 36/59 R |
| 3,988,840 | A | * | 11/1976 | Minihane | 36/32 R |
| 4,180,923 | A | * | 1/1980 | Dassler | 36/32 R |
| 4,266,349 | A | | 5/1981 | Schmohl | |
| 4,327,503 | A | | 5/1982 | Johnson | |
| 4,347,674 | A | | 9/1982 | George | |
| 4,378,643 | A | * | 4/1983 | Johnson | 36/129 |
| 4,445,286 | A | | 5/1984 | Norton | |
| 4,498,251 | A | * | 2/1985 | Shin | 36/30 R |
| 4,538,366 | A | * | 9/1985 | Norton | 36/32 R |
| 4,586,274 | A | | 5/1986 | Blair | |
| 4,667,425 | A | | 5/1987 | Effler et al. | |
| D294,655 | S | | 3/1988 | Heyes | |
| D295,231 | S | | 4/1988 | Heyes | |
| 4,745,693 | A | | 5/1988 | Brown | |
| 4,885,851 | A | | 12/1989 | Peterson | |
| 4,914,838 | A | | 4/1990 | Ihlenburg | |
| D323,738 | S | | 2/1992 | Eisenbach | |
| D324,763 | S | | 3/1992 | Kayano | |
| 5,203,097 | A | | 4/1993 | Blair | |
| D354,845 | S | | 1/1995 | Bramani | |
| D371,893 | S | | 7/1996 | Kayano et al. | |
| D373,898 | S | | 9/1996 | Bramani | |
| 5,628,129 | A | | 5/1997 | Kilgore et al. | |
| D391,044 | S | | 2/1998 | Backus | |
| D392,448 | S | | 3/1998 | Backus | |
| 5,768,809 | A | | 6/1998 | Savoie | |
| 5,832,636 | A | * | 11/1998 | Lyden et al. | 36/59 R |
| 5,873,184 | A | | 2/1999 | Ihlenburg | |
| 5,987,782 | A | | 11/1999 | Bramani | |
| 6,016,613 | A | * | 1/2000 | Campbell et al. | 36/59 C |
| 6,101,746 | A | * | 8/2000 | Evans | 36/128 |
| 6,161,315 | A | * | 12/2000 | Dalton | 36/134 |
| D443,407 | S | | 6/2001 | Patterson et al. | |
| 6,357,146 | B1 | * | 3/2002 | Wordsworth et al. | 36/128 |
| 2002/0166263 | A1 | * | 11/2002 | Sink | 36/127 |

OTHER PUBLICATIONS

Keith R. Williams et al., "The Mechanics of Foot Action During the Golf Swing and Implications for Shoe Design," Medicine and Science in Sports and Exercise, vol. 15, No. 3, pp247–255.

1999 NIKE Golf Footwear/Equipment Catalog, published Jun. 1998, cover page and one page.

2000 NIKE Golf Footwear Catalog, published Jun. 1999, cover page and two pages.

* cited by examiner

*Primary Examiner*—Ted Kavanaugh
(74) *Attorney, Agent, or Firm*—Banner & Witcoff, Ltd.

(57) ABSTRACT

An outsole for an athletic shoe, in particular a golf shoe, having a plurality of traction elements of resisting rotational movement parallel to a plane surface of the ground. Traction elements in a forefoot region of the outsole are oriented with resist surfaces facing a lateral edge and traction elements in a rearfoot region of the outsole are oriented with resist surfaces a medial direction. The resist surfaces of the traction elements are substantially perpendicular to a base surface of the outsole and other surfaces of the traction element can be connected to the base surface by concave curvatures. The traction elements may have an indented surface. A plurality of the traction elements may be arranged along longitudinal and radial arrays in a forefoot region.

35 Claims, 5 Drawing Sheets

GOLF SHOE OUTSOLE WITH ORIENTED TRACTION ELEMENTS

FIELD OF THE INVENTION

The present invention relates to an outsole for an article of footwear having protruding members that provide directional stability, and more particularly to an athletic shoe having protruding traction elements that resist slippage caused by movement of the body tending to shift the feet with respect to the ground surface, and still more particularly, the invention relates to golf shoes having cleat members and traction elements, the latter oriented and shaped to resist rotational shear force slippage due to a golf swing moving the body and tending to shift the golfer's feet with respect to the ground surface.

BACKGROUND OF THE INVENTION

Golf is one of the oldest international sports having its formal source of origin with royal and ancient golf clubs of St. Andrew, Scotland. Over time, golf has gained a populous following due to its prestigious reputation, its challenges, and its suitability for relaxation.

Proper athletic shoes for golf have evolved over time to meet growing demands. Outsoles for golf shoes are of particular interest especially with respect to enhancing performance in the game by insuring controlled contact with the ground while pivoting the body for purposes of swinging a golf club.

Traditional golf shoe outsoles included spikes for engaging the ground to aid in preventing slippage of each foot during the back swing and follow through swing of a golf club. Six or seven removeable spikes were typically located in the forefoot region of the outsole and two to four removeable spikes were located in the rearfoot region (i.e., heel) of the outsole. The traditional golf shoe outsole generally included a planar and often leather walking surface in which the spikes were fixed or removeably anchored.

From the mere use of spikes, modifications to golf shoe outsoles have been made. For example, U.S. Pat. No. 4,885,851 to Peterson includes an outsole having a flat, ground engaging surface with spikes in the forefoot and rearfoot regions positioned and along an inner and outer sides of the outsole. The outsole of Peterson includes supplementary protrusions distributed along an inner side of the right foot shoe and along an outer side of the left foot shoe (for a right handed golfer having a left foot closest to the flag). One purpose of the supplementary protrusions is to inhibit slippage as the golfer shifts his weight from the right foot to the left foot while swinging a golf club from right to left. A drawback of this design, however, is that right and left handed golfers require different shoe models since left handed golfers shift their body weight to opposite sides of the shoes as compared to right handed golfers.

U.S. Pat. No. 6,161,315 to Dalton illustrates a golf shoe having removeable spikes, and additional mini spikes and ridges, In particular, a ridge is disposed along the perimeter of the forefoot, the heel, or both.

Another golf shoe outsole is shown by the U.S. Pat. No. 6,016,613 to Campbell et al., which includes traction projections extending generally radially outward from a pivot point in the forefoot region and another pivot point in the rearfoot region.

In order to fully appreciate the present invention and its uniqueness, one should understand a golf swing and its complex, coordinated side-to-side and twisting motion that involves the arms, torso, hips, legs, and knee, ankle and foot joints of the golfer. Initially, a golfer's weight is uniformly distributed over each foot with a majority of gravitational force vertically downward and with very little lateral or medial shear force of the bottom of the feet with respect to the ground surface. As a golfer begins the back swing, the rearfoot farthest from the flag known as the driving foot, tends to experience a greater vertical force and tends to rotate lateral outward at the forefoot region and medially inward at the rearfoot region. During the back swing, this driving foot acts as a bracing foot and serves to counter rotational force of the legs, hips, and upper body of the golfer. At the same time, most of the golfer's weight shifts to the bracing foot so that the forward foot closest to the flag known as the stabilizing foot, has almost all of the golfer's weight pulled off of it.

After the club head crests and as the golfer begins the down swing to follow-through, the golfer's weight is shifted from the rear driving foot to the forward stabilizing foot causing the stabilizing foot to become the new bracing foot. The new bracing foot has a tendency to rotate similar to the first bracing foot, that is, rotate laterally outward at the forefoot region and medially inward at the rearfoot region.

It is desirable to prevent rotation of the foot serving as the bracing foot for stability and to enhance strength and accuracy in performance. It is also desirable to permit the foot acting as the non-bracing foot to release slightly from the ground surface to prevent undue stress and strain on non-bracing foot.

In view of the foregoing, a need exists for an outsole of an athletic shoe that has traction elements that tend to resist rotational movement toward a lateral side of the forefoot and toward a medial side of the rearfoot. In addition, a need exists for an outsole capable of providing release in opposing directions to prevent undue foot and ankle strain of the wearer.

SUMMARY OF THE INVENTION

The present invention is directed to an article of footwear having an outsole that has a base surface exposed to a ground surface and a plurality of traction elements extending from the base surface which tend to resist lateral rotation. The traction elements may be in addition to removeable or fixed cleat members.

The traction elements are oriented to prevent clockwise rotation of the right foot and counter-clockwise rotation of the left foot from the perspective of looking down at the tops of the feet. For serving this purpose, the traction elements have resist surfaces connected substantially perpendicular to a base surface of the outsole of a shoe. The resist surfaces are oriented to resist shear force slippage of the outsole in the above identified directions with respect to the ground surface. In order to resist shear forces in the aforementioned directions, the rearfoot region traction elements have resist surfaces facing a medial edge of the rearfoot region so as to resist rotational slippage of the rearfoot region in the medial direction; and the forefoot region traction elements are oriented so that the resist surfaces are generally facing a lateral edge of the forefoot region so as to resist rotational slippage of the forefoot in the lateral direction. Since the lateral edge of a shoe typically curves in the forefoot region, the resist surfaces splay generally radially outward to face the lateral edge. A localized region located medial to the forefoot region may be a source origin for the radially outward splay of traction elements.

The traction elements may each be composed of two plate portions and a spacer portion sandwiched therebetween forming a generally rectangular or parallelogram element, in plan view, that can be integrally formed or made of separate members. The two plate portions of the traction elements can protrude vertically and horizontally farther from the base surface than the sandwiched spacer portions for providing plate portion edges that tend to depress into a ground surface more readily than a flat topped or flat sided traction element. Sides of the plate portions may flare outward in a direction from a tip thereof to a base surface in plan view. The traction elements are connected to the base surface with concave curvatures along three edges to aid in preventing clogging of the outsole with mud and other debris.

Various advantages and features of novelty which characterize the invention are pointed out with particularity in the claims. However, for a better understanding of the invention, its advantages, and objects obtained by its use, reference should be made to the drawings and to the accompanying descriptive matter, in which there is illustrated and described one or more preferred embodiments of the invention.

DETAILED DESCRIPTION OF THE PREFERRED EMBODIMENTS

Figure 1:
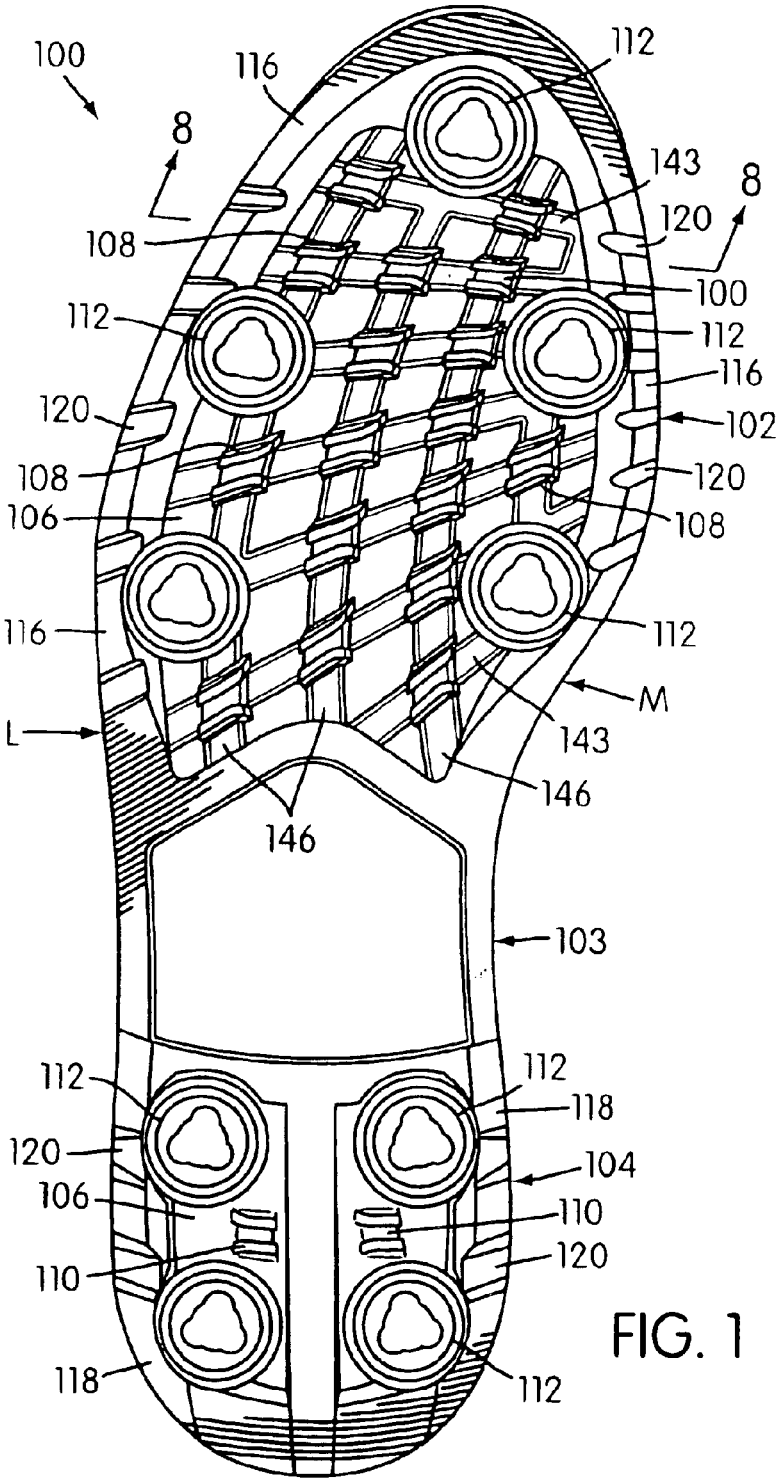
FIG. 1 is a plan view of a ground engaging outsole surface of a right foot shoe.
Figure 2:
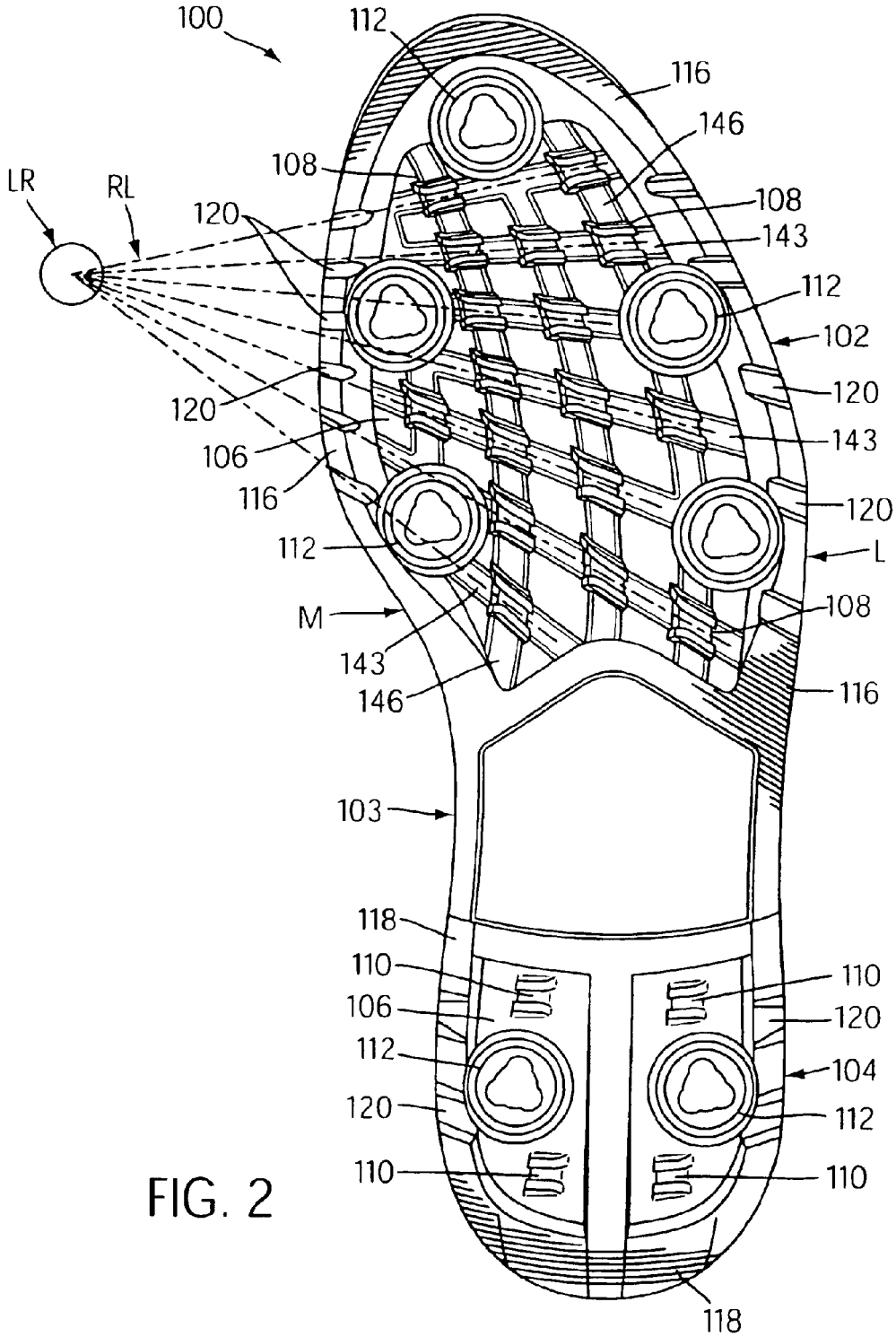
FIG. 2 is a plan view of a ground engaging outsole surface of a left foot shoe, illustrating an alternate heel structure.
Figure 9:
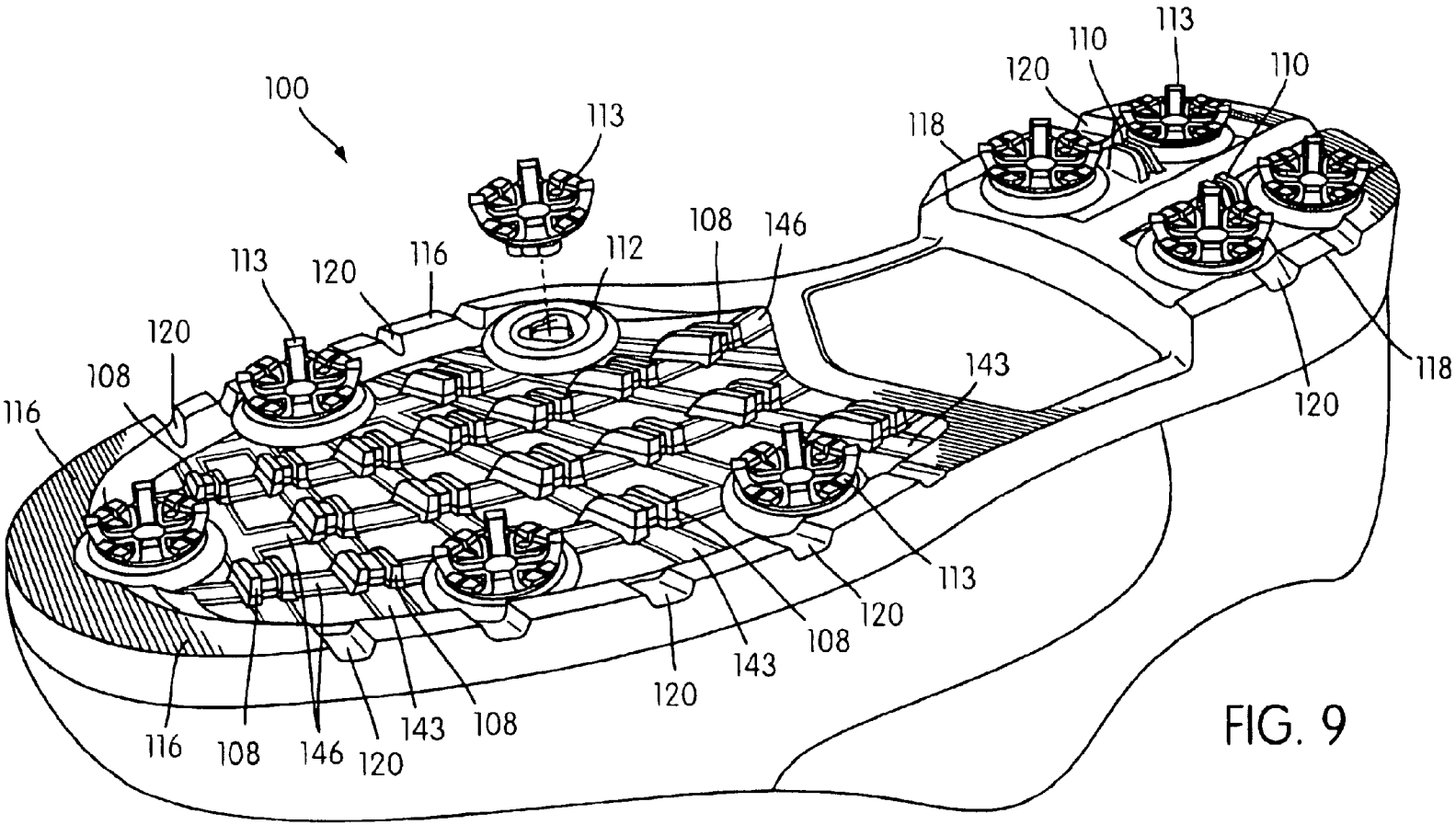

Referring to FIG. 1, one embodiment of an outsole 100 for a right athletic shoe is shown in accordance with the invention. FIG. 2 illustrates a similar outsole 100 for a left athletic shoe, with an alternate structure in the rearfoot region. Outsoles 100 include a forefoot region 102 and a rearfoot region 104 and may include an instep region 103 positioned in between. Outsoles 100 have a base surface 106 from which forefoot traction elements 108 and rearfoot traction elements 110 outwardly extend. Outsole 100 is shown attached to a conventional upper in FIG. 9. An article of footwear as shown in FIG. 9 would be generally used as a golf shoe.

The traction elements are purposefully oriented, so that, a bottom of a wearer's right foot resists clockwise rotation in relation the ground surface and the bottom of the wearer's left foot resists counter-clockwise rotation in relation to the ground surface. Stated another way, the forefoot traction elements 108 are oriented to resist a rotational force in the lateral direction (that is, away from a body vertical center line) and the rearfoot traction elements 110 are oriented to resist a rotational force in the medial direction (toward the body vertical center line). This is true for both the right and left shoe. It is also true for a right or a left handed golfer. Cleat receptacles 112 may be provided for receiving removeable cleats 113. Cleats 113 are generally positioned along a lateral edge L and a medial edge M of each outsole 100 for further resisting slippage with respect to the ground surface. Individually, and in combination, traction elements 108 and 110, and cleats 113 enhance stability of the wearer's feet in relation to the ground surface by aiding in preventing shear force slippage.

Forefoot traction elements 108 are preferably aligned along radial lines RL emanating from a localized region LR located medially of medial edge M. Additionally, forefoot traction elements can be positioned to extend from raised paths 143. Radial lines RL can coincide with paths 143, but need not. Further discussion of paths 143 follows in the description of manufacturing one embodiment of the outsole and traction elements.

Forefoot traction elements 108 and rearfoot traction elements 110 each are similarly shaped to include a resist surface 122. See FIGS. 3-4. Resist surface 122 is predominantly the surface of each traction element that resists rotational movement and slippage of the outsole 100 and thus resist slippage of wearer's foot with respect to the ground surface in the aforementioned directions during a golf swing motion, for example.

Traction elements 108 and 110 can be formed of a first plate portion 123 and a second plate portion 124, which sandwich a spacer portion 126. See FIG. 3. Note, the plate and spacer portions include regions above and below the dotted line as will be later discussed in the manufacturing description of the one embodiment. First plate portion 123 and second plate portion 124 extend vertically from base surface 106 to an extent greater than spacer portion 126 so as to provide a first plate tip edge portion 127 and a second plate tip edge portion 128. Thus, forming a tip surface 136 of the traction elements which includes an indentation at top surface 129 of spacer portion 126. Tip surface 136 with an indentation at top surface 129 tends to more readily depress or penetrate into a ground surface as compared to a traction element with a flat or blunt tip surface, for example. Sides of plate portions 123 and 124 may flare outward in a direction from a tip thereof to a base surface, in plan view.

Resist surface 122 includes a horizontally extending, first plate resist edge portion 130 and second plate resist edge portion 132 for similar ground penetration purposes and thus improved shear resistance of outsole 100 in relation to the ground surface. In between the aforementioned edge portions 130 and 132, resist surface 122 includes vertical wall 131 of spacer member 126 indented in relation to edge portions 130 and 132.

Figure 3:
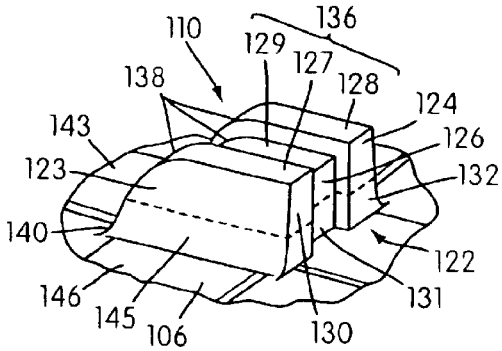
FIG. 3 is a perspective view of a traction element.
Figure 4:
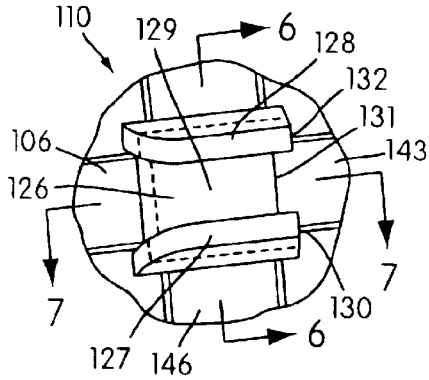
FIG. 4 is plan view of the traction element of FIG. 3.
Figure 7:
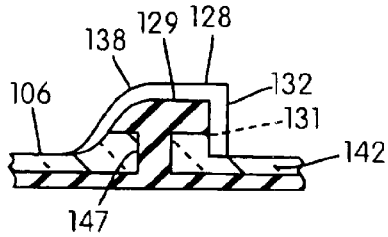

Resist surface 122 is substantially perpendicular to base surface 106 and is connected thereto at substantially a right angle, as best seen in FIGS. 3 and 7. Resist surface 122 provides substantially a vertical wall surface of traction elements 108 and 110 that tends to resist shear forces of the foot in relation to the ground surface. Resist surface 122 is connected substantially perpendicularly to tip surface 136 providing substantially a right angled corner (not labeled) that tends to dig into the ground surface. As stated above, tip surface 136 includes first plate tip edge portion 127, second plate tip edge portion 128, and a top surface 129 of spacer 126.

Opposite the right angled corner that connects resist surface 122 to tip surface 136, and generally diagonally opposite the right angled corner that connects resist surface 122 to base surface 106, is a tip edge 138 that is convexly curved. To inhibit clogging of outsole 100 with debris such as grass clippings, traction elements 108 and 110 can include concave curvatures 140 connected to base surface 106 on three sides with the exception resist surface 122. Resist surface 122 preferably is connected at substantially a right angle at base surface 106 for maximum shear force resistance to the ground surface.

Outsoles 100 may include a raised forefoot rim 116 extending around an outer peripheral edge of forefoot region 102, and a raised rearfoot rim 118 extending around an outer peripheral edge of rearfoot region 104. Rims 116 and 118 are slightly lower than respective traction elements 108 and 110, but higher than base surface 106. The surface area of rims 116 and 118 keeps the golf shoe from simply penetrating a green surface and making deep marks on the green. That is, rims 116 and 118 spread the weight of the golfer over a larger surface area for a green-friendly bottom. In addition, forefoot rim 116 and rearfoot rim 118 may have a tread textured surface, as schematically indicated, for aiding in preventing slippage in relation to the ground surface. Forefoot rim 116 and rearfoot rim 118 may have a plurality of notches 120 to aid in heel-to-toe rolling flexibility of outsoles 100.

Figure 5:
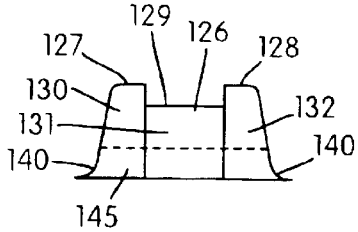
FIG. 5 is an end view of the traction element of FIG. 3.
Figure 6:
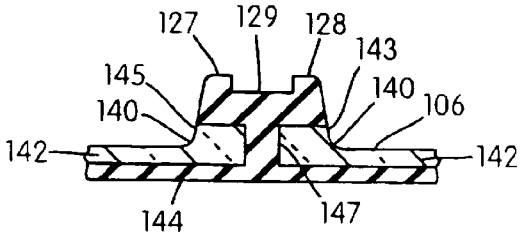
FIG. 6 is a cross-sectional view of the traction element of FIG. 4 taken along section line 6—6; and, FIG. 7 is a cross-sectional view of the traction element of FIG. 4 taken along section line 7—7.

Manufacturing of outsole 100 with traction elements 108 can be accomplished using either an injection molding process or a rubber press molding process. An injection molding process is preferably used when outsole 100 is to be made from two materials; and a rubber press molding process is preferably used when outsole 100 is to be made of a single material. However, an injection molding process can also be used to make outsole 100 from a single material. For example, in an injection mold, a first material forms a base 142 having base surface 106 and also forms a pedestal portion 145 having a channel 147. In a second injection molding step, a second material 144 may be connected to base 142 at a location opposite base surface 106. Second material 144 may extend through a channel 147 in pedestal portion 145, and extend outward thereof to complete the shape of traction elements 108 or 110. The mating of the two materials is shown in FIGS. 6-7, and shown schematically by a dashed line in FIGS. 3-5. Traction elements 110 may be similarly formed. Alternatively, traction elements 108 and 110 can be formed solidly of the first material that forms base 142.

The first material forming base 142 generally has a physical property that hinders clogging of the traction elements, and the second material generally has a physical property that aids in frictionally preventing slipping while walking on a hard surface, for example. The combination of the first and second materials makes for a durable traction element that has structural integrity due to the hardness of the first material, yet has a comfortable walking surface due the second material's ability to grip a ground surface. For aesthetic purposes the first material of base 142 may be translucent and the second material 144 may be visible through the first material. The forefoot traction elements 108 in FIG. 9 show the visual differentiation between the first translucent material 142 and the second material 144 by the solid horizontal line intermediate the traction elements 108. When outsole 100 is made from two materials, each material can be a thermoplastic polyurethane, such as a polyether/polyamide TPU, with the TPU of the second material 144 being more durable than the TPU of the first material. If outsole 100 is made from a single material, a conventional durable TPU or other plastic or rubber material can be used.

Figure 8:
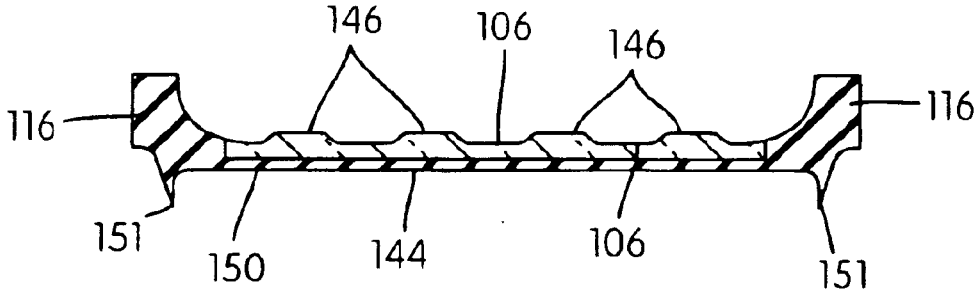
FIG. 8 is a cross-section view of the ground engaging outsole of FIG. 1 taken along line 8—8; and, FIG. 9 is a perspective view of a golf shoe, illustrating the ground engaging outsole of the right foot shoe shown in FIG. 1 with cleats.

FIGS. 1, 2 and 9 illustrate radial paths 143 and longitudinal paths 146 along base surface 106. These paths may be slightly raised for added traction and/or for aesthetics to emphasize the orientation of traction elements 108. Aesthetically, paths 143 and 146 could be an alternate color or tint that is visible through a translucent base 142. As shown in FIG. 8, second material 144 can form a footbed surface 150 having side walls 151, and form rims 116.

Cleat receptacles 112 may be of the type taught by U.S. Pat. No. 5,768,809 to Savoie, incorporated herein by reference. Cleat receptacles 112 can be connected with outsole 100 by shaping the first material that forms base 142 around a circumference of cleat receptacles 112. As seen in FIGS. 1, 2, and 9, cleat receptacles are located around the perimeter of outsole 100, preferably abutting rims 116 and 118.

Forefoot traction elements 108 are aligned in arrays along several longitudinal paths 146 that are positioned generally parallel to lateral edge L. Forefoot traction elements 108 may also be positioned in arrays along radial paths 143 which emanate generally from a localized region LR positioned exteriorly from medial edge M of the forefoot so as to concentrate resist surfaces 122 generally perpendicular to the directions that the wearer's foot tends to rotate during the back swing and through-swing of a golf club. Such orientation also places resist surface 122 generally parallel to lateral edge L. As evident in FIGS. 1-2 and 9, first and second plate portions 123 and 124 may shift in relation to spacer portion 126 forming a more parallelogram than rectangular traction element in plan view of the tip surface. The shift in plate portions 123 and 124 helps keep resist surfaces 122 generally parallel to lateral edge L. The sides of first and second plate portions 123 and 124 may also flare outward in a direction of the tip to the base.

When an athletic shoe with outsole 100 is used by either a right handed or left handed golfer, forefoot traction elements 108 serve to resist outward lateral rotation, and rearfoot traction elements 110 serve to resist inward medial rotation. For a right handed golfer, the right foot is the driving foot located farthest from the flag. It bears the greatest vertical force (i.e., more of the golfer's weight) during the back swing and thus must remain a secure bracing foot and preferably prevented from rotational slippage. As the golf club begins the down swing to follow through, a golfer's weight is transferred to the stabilizing foot located closest to the flag. The stabilizing foot then becomes the new bracing foot and tends to rotate counter-clockwise outward at a lateral side of the forefoot region and inward at a medial side of the rearfoot region. As stated above, forefoot traction elements 108 and rearfoot traction elements 110 for the stabilizing foot\bracing foot are oriented so that resist surfaces 122 aid in preventing counter-clockwise rotation of the left foot.

The tendency of the wearer's feet to rotate lateral outward at the forefoot region and medially inward at the rearfoot region is substantially similar for a left handed golfer, the difference being that the driving foot and stabilizing foot are switched, such that, the left foot of a left handed golfer bears his weight on his left driving foot first, and then on his right stabilizing foot on down swing and follow-through. So, the left driving foot is first a bracing foot then the right stabilizing foot becomes the new bracing foot. The inventive traction elements thus may be oriented substantially the same for right and left handed golfers without compromise to either.

It is appreciated that additional traction elements 110 may be provided in rearfoot region 104 in addition to or in substitution for some of rearfoot cleat receptacles 112. For example, FIG. 2 illustrates an embodiment where only two cleat receptacles are used and the number of traction elements 110 is increased to four. If desired, more traction elements 110 could be located in the rearfoot region. It is also appreciated that forefoot traction elements 108 need not be positioned along paths 143 and may be offset, while still maintaining resist surfaces 122 in generally parallel relation to lateral edge L. This may serve the purpose of bringing resist surfaces 122 out from behind a neighboring traction element to help increase exposure of resist surfaces 112. It is further appreciated that plate portions 123 and 124 could be formed of a first material and the spacer portion 126 formed of a second material. It is further appreciated that while twist and lock cleat receptacles 112 are shown, other types of cleat fixtures or attachments may be substituted, or the cleats 113 may be made integral, or the cleats 113 may be obviated in favor of traction elements 108 and 110.

The foregoing description of the specific embodiments reveals the general nature of the invention that others can, by applying current knowledge, readily modify and/or adapt for various applications such specific embodiments without undue experimentation and without departing from inventive concepts disclosed, and, therefore, such adaptations and modifications should and are intended to be comprehended within the meaning and range of equivalents of the disclosed embodiments. The means and materials for caring out various disclosed functions may take a variety of alternative forms without departing from the spirit of invention.

What is claimed is:

1. An article of footwear having an outsole, the outsole having a base surface and a traction element, the base surface being exposed to a ground surface, and said traction element being a protrusion extending from the base surface to a tip surface, said protrusion being connected to the base surface by a concave curvature along at least one edge, and having at least one resist surface with a substantially planar wall sue extending substantially perpendicular from said base surface and being adapted to resist shear force slippage of the outsole with respect to the ground surface in at least one of a lateral or medial direction, said protrusion having a convexly curved edge opposite said resist surface, and said tip surface having an indented portion.

2. The article of footwear of claim 1, wherein said protrusion is connected to the base surface by said concave curvature along three edges.

3. The article of footwear of claim 2, wherein said tip surface is substantially perpendicular to said resist surface.

4. The article of footwear of claim 1, wherein said protrusion has a first plate portion and a second plate portion disposed on opposite sides of a spacer portion, said first and second plate portions protruding to a greater extent outward from said base surface than said spacer portion, thereby forming said indented portion of said tip surface.

5. The article of footwear of claim 4, wherein said first and second plate portions extend along the base surface to a greater extent than said spacer portion.

6. The article of footwear of claim 5, wherein said first and second plate portions and said spacer portion are integral.

7. The article of footwear of claim 4, wherein said first and second plate portions flare outwardly from one another in a direction from said tip surface toward said base surface.

8. A golf article of footwear comprising:

an upper and a sole attached to said upper;

said sole including an outsole comprising a forefoot region having a medial, lateral, and front edge surrounding a forefoot interior area, a forefoot base surface and a plurality of forefoot traction elements extending from said forefoot base surface in said forefoot interior area, each of said forefoot traction elements having a resist surface extending substantially at a right angle to said forefoot base surface and a concavely curved edge connected to said forefoot base surface at a location opposite from said resist surface, each resist surface facing said lateral edge of said forefoot region, said forefoot traction elements being arranged in a plurality of longitudinal arrays in an interior area of said forefoot region, one of said plurality of longitudinal arrays extending along a first curved line generally parallel to said lateral edge of said forefoot region, and another of said plurality of longitudinal arrays extending along at least one additional curved line generally parallel to said first line, and groups of said plurality of forefoot traction elements being positioned along radial lines extending from a localized region medial to said forefoot region;

a rearfoot region having lateral, medial and rear edges surrounding an interior rearfoot area, a rearfoot base surface and a plurality of rearfoot traction elements extending from said rearfoot base surface in said interior rearfoot area, said each of rearfoot traction elements having a resist surface facing said medial edge of said rearfoot region;

wherein said resist surface of said plurality of forefoot traction elements resist slippage of the forefoot region of said outsole in a lateral direction, and said resist surface of said rearfoot traction elements resist slippage of the rearfoot region of said outsole in a medial direction; and a protruding rim at said lateral and medial edges, said protruding rim extending outward from said forefoot and rearfoot base surfaces at least ally along a perimeter of said outsole.

9. The article of footwear of claim 8, wherein the majority of said plurality of traction elements protrude a greater distance from said base surface than said protruding rim.

10. The article of footwear of claim 8, wherein each of said forefoot and rearfoot plurality of traction elements have said concavely curved edge connected to said base surface.

11. The article of footwear of claim 8, wherein each of said plurality of traction elements has an indentation at said resist surface.

12. The article of footwear of claim 8, wherein said indentation extends from said base surface and along said resist surface to a tip surface of each said traction elements, said indentation continuing at least across said tip surface of each said traction elements.

13. The article of footwear of claim 8, wherein at least a majority of said plurality of traction elements comprises a first plate portion, a second plate portion, and a spacer portion in between said first and second plate portions, said spacer portion having smaller dimensions than said first and second plate portions to form an indentation.

14. An article of footwear having an outsole, the outsole comprising:

a forefoot region having a medial, a lateral, and front edges, surrounding a forefoot interior area, a forefoot base surface and a plurality of forefoot traction elements extending from said forefoot base surface in said forefoot interior area, each of said forefoot traction elements having a resist surface extending substantially at a right angle to said forefoot base surface, each resist surface facing said lateral edge of said forefoot region, said forefoot traction elements being arranged in a plurality of longitudinal arrays in an interior area of said forefoot region, one of said plurality of longitudinal arrays extending along a first curved line generally parallel to said lateral edge of said forefoot region, and another of said plurality of longitudinal arrays extending along at least one additional curved line generally parallel to said first line, and groups of said plurality of forefoot traction elements being positioned along radial lines extending from a localized region medial to said forefoot region;

a rearfoot region having lateral, medial and rear edges surrounding an interior rearfoot area, a rearfoot base surface and a plurality of rearfoot traction elements extending from said rearfoot base surface in said interior rearfoot area, said each of rearfoot traction elements having a resist surface facing said medial edge of said rearfoot region; wherein said resist surfaces of said plurality of forefoot traction elements resist slippage of the forefoot region of said outsole in a lateral direction, and said resist surface of said rearfoot traction elements resist slippage of the rearfoot region of said outsole in a medial direction, and each of said plurality of traction elements has a concavely curved edge connected to said base surface, said concavely curved edge located opposite from said resist surface at said base surface.

15. An article of footwear having an outsole, the outsole comprising:

a forefoot region having a medial, a lateral, and front edges, surrounding a forefoot interior area, a forefoot base surface and a plurality of forefoot traction elements extending from said forefoot base surface in said forefoot interior area, each of said forefoot traction elements having a resist surface extending substantially at a right angle to said forefoot base surface, each resist surface facing said lateral edge of said forefoot region, said forefoot traction elements being arranged in a plurality of longitudinal arrays in an interior area of said forefoot region, one of said plurality of longitudinal arrays extending along a first curved line generally parallel to said lateral edge of said forefoot region, and another of said plurality of longitudinal arrays extending along at least one additional curved line generally parallel to said first line, and groups of said plurality of forefoot traction elements being positioned along radial lines extending from a localized region medial to said forefoot region;

a rearfoot region having lateral, medial and rear edges surrounding an interior rearfoot area, a rearfoot base surface and a plurality of rearfoot traction elements extending from said rearfoot base surface in said interior rearfoot area, said each of rearfoot traction elements having a resist surface facing said medial edge of said rearfoot region;

wherein said resist surfaces of said plurality of forefoot traction elements resist slippage of the forefoot region of said outsole in a lateral direction, and said resist surface of said rearfoot traction elements resist slippage of the rearfoot region of said outsole in a medial direction, and each of said plurality of traction elements has an indentation at said resist surface.

16. The article of footwear of clam 15, wherein said indentation extends from said base surface and along said resist surface to a tip surface of each said traction elements, said indentation continuing at least across said tip surface of each said traction elements.

17. An article of footwear having an outsole, the outsole comprising:

a forefoot region having a medial, a lateral, and front edges, surrounding a forefoot interior area, a forefoot base surface and a plurality of forefoot traction elements extending from said forefoot base surface in said forefoot interior area, each of said forefoot traction elements having a resist surface extending substantially at a right angle to said forefoot base surface, each resist surface facing said lateral edge of said forefoot region, said forefoot traction elements being arranged in a plurality of longitudinal arrays in an interior area of said forefoot region, one of said plurality of longitudinal arrays extending along a first curved line generally parallel to said lateral edge of said forefoot region, and another of said plurality of longitudinal arrays extending along at least one additional curved line generally parallel to said first line, and groups of said plurality of forefoot traction elements being positioned along radial line extending from a localized region medial to said forefoot region;

a rearfoot region having lateral, medial and rear edges surrounding an interior rearfoot area, a rearfoot base surface and a plurality of rearfoot traction elements extending from said rearfoot base surface in said interior rearfoot area, said each of rearfoot traction elements having a resist surface facing said medial edge of said rearfoot region;

wherein said resist surfaces of said plurality of forefoot traction elements resist slippage of the forefoot region of said outsole in a lateral direction, and said resist surface of said rearfoot traction elements resist slippage of the rearfoot region of said outsole in a medial direction, and at least a majority of said plurality of traction elements comprises a first plate portion, a second plate portion and a spacer portion in between said first and second plate portions, said spacer portion having smaller dimensions than said first and second plate portions to form an indentation.

18. The article of footwear of claim 17, wherein said first and second plate portions and said spacer portion are integral.

19. An article of footwear with an upper and a sole secured to the upper, the sole comprising:

an outsole that defines a lateral edge and an opposite medial edge, the outsole being located in at least a forefoot region and a rearfoot region of the footwear; and a plurality of traction elements extending from the outsole, each of the traction elements including a resist surface and an opposite convexly-curved surface, each of the resist surfaces extending at a substantially right angle to the outsole, wherein, the resist surfaces of substantially all of the traction elements located in the forefoot region are oriented to face the lateral edge, and the resist surfaces of substantially all of the traction elements located in the rearfoot region are oriented to face the medial edge, and at least on of the traction elements has a concavely curved edge connected to the outsole.

20. The article of footwear of claim 19, further comprising a plurality of cleat members.

21. The article of footwear of claim 20, further comprising a plurality of receptacles adapted to removeably receive the plurality of cleat members.

22. The article of footwear of claim 21, wherein the plurality of receptacles are positioned adjacent the lateral edge and the medial edge.

23. The article of footwear of claim 19, wherein the traction elements located in the forefoot region are arranged in a plurality of longitudinal arrays.

24. The article of footwear of claim 23, wherein one of the longitudinal arrays extends along a first curved line generally parallel to the lateral edge, and another of the longitudinal arrays is parallel to the first line.

25. The article of footwear of claim 19, wherein groups of the traction elements are positioned along radial lines extending from a localized region medial to the forefoot region.

26. The article of footwear of claim 19, an indentation is formed in at least one of the traction elements.

27. The article of footwear of claim 26, wherein the traction elements include a first plate portion, a second plate portion, and a spacer portion positioned in between the first and second plate portions, the spacer portion having lesser dimensions than the first and second plate portions to form the indentation.

28. An article of footwear with an upper and a sole secured to the upper, the sole comprising:

an outsole that defines a lateral edge and an opposite medial edge, the outsole being located in at least a forefoot region and a rearfoot region of the footwear; and a plurality of traction elements protruding from the outsole, the traction elements in the forefoot region being arranged in a plurality of longitudinal arrays extending in a direction that is generally parallel to one of the lateral edge and the medial edge, and the traction elements in the forefoot region being positioned along radial lines that are generally perpendicular to the lateral edge and the medial edge, each of the traction elements including a resist surface and an opposite convexly-curved surface, each of the resist surface extending at a substantially right angle to the outsole.

29. The article of footwear of claim 28, wherein the radial lines emanate from a localized region spaced outward from one of the lateral edge and the medial edge.

30. The article of footwear of claim 28, wherein the radial lines emanate from localized region spaced outward from the medial edge.

31. The article of footwear of claim 28, wherein a first portion of the traction elements are located in the forefoot region, each of the resist surfaces of the fist portion facing the lateral edge.

32. The article of footwear of claim 31, wherein a second portion of the traction elements are located in the rearfoot region, each of the resist surfaces of the second portion facing the medial edge.

33. The article of footwear of claim 28, wherein at least one of the traction elements has a concavely curved edge connected to the outsole.

34. The article of footwear of claim 28, an indentation is formed in at least one of the traction elements.

35. The article of footwear of claim 28, wherein the traction elements include a first plate portion, a second plate portion, and a spacer portion positioned in between the first and second plate portions, the spacer portion having lesser dimensions than the first and second plate portions to form the indentation.

* * * * *